US006779699B2

(12) United States Patent
Aoki et al.

(10) Patent No.: US 6,779,699 B2
(45) Date of Patent: Aug. 24, 2004

(54) PNEUMATICALLY OPERATED NAIL GUN HAVING CYLINDER FLOATING PREVENTION ARRANGEMENT

(75) Inventors: Masanori Aoki, Hitachinaka (JP); Yoshinori Ishizawa, Hitachinaka (JP)

(73) Assignee: Hitachi Koki Co., Ltd., Tokyo (JP)

( * ) Notice: Subject to any disclaimer, the term of this patent is extended or adjusted under 35 U.S.C. 154(b) by 0 days.

(21) Appl. No.: 10/620,370

(22) Filed: Jul. 17, 2003

(65) Prior Publication Data

US 2004/0011846 A1 Jan. 22, 2004

(30) Foreign Application Priority Data

Jul. 19, 2002 (JP) ..... 2002-211835

(51) Int. Cl.[7] ..... B25C 1/04
(52) U.S. Cl. ..... 227/130; 173/210
(58) Field of Search ..... 227/10, 130, 156; 173/210, 211

(56) References Cited

U.S. PATENT DOCUMENTS 4,475,680 A * 10/1984 Farian ..... 227/130
4,932,480 A * 6/1990 Golsch ..... 173/210
5,437,339 A * 8/1995 Tanaka ..... 173/210
5,441,192 A * 8/1995 Sugita et al. ..... 227/130
5,911,351 A * 6/1999 White ..... 227/130
6,045,024 A * 4/2000 Phillips ..... 227/130
6,182,881 B1 * 2/2001 Kellner et al. ..... 227/10
6,318,239 B1 * 11/2001 Tsukada ..... 92/85 R
6,533,156 B1 * 3/2003 Chang ..... 227/130
6,619,527 B1 * 9/2003 Moeller ..... 227/10

* cited by examiner

*Primary Examiner*—Scott A. Smith
(74) *Attorney, Agent, or Firm*—Sughrue Mion, PLLC

(57) ABSTRACT

A pneumatically operated nail gun having an arrangement for preventing a cylinder from floating due to impact of a piston against a piston bumper. When the piston is pneumatically moved toward its lower dead center for nail driving, the piston strikes against the piston bumper. The bumper generates a force for urging the cylinder toward top dead center of the piston. A plurality of ribs provided with seat portions protrude radially outwardly from the cylinder and spaced away from each other in a circumferential direction thereof. A lower end of a separator, which interconnects a main housing with an exhaust cover, is positioned above each seat portion of each rib. A metal washer is seated on the seat portions, and a flexible damper ring is mounted on the washer and below the lower end of the separator. Upward force of the cylinder is moderated and dampened by the damper ring.

6 Claims, 5 Drawing Sheets

PNEUMATICALLY OPERATED NAIL GUN HAVING CYLINDER FLOATING PREVENTION ARRANGEMENT

BACKGROUND OF THE INVENTION

The present invention relates to a pneumatically operated nail gun, and more particularly, to such a nail gun having an arrangement for preventing a cylinder from floating.

In a conventional nail gun, as shown in FIGS. 1 and 2, a main housing 2 and an exhaust cover 13 define an outer case. The main housing 2 is connected to the exhaust cover 13 through a separator 25. The outer case defines therein a compressed air chamber 3. A tail cover 18 is disposed at a lower end of the main housing 2. A cylinder 8 is fixed to the main housing 2, and a piston 4 having a driver blade 4A is slidably disposed in the cylinder 8 through a seal ring 5 assembled in a ring groove 4*a* of the piston 4. The driver blade 4A can extends through the tail cover 18 for driving a nail fed to the tail cover 18.

The lower portion of the cylinder 8 has a conical section 8*a* in which inner and outer diameters are gradually increased toward a tail cover 18. Further, a piston bumper 12 is disposed at the lower end of the cylinder 8 for absorbing a surplus energy of the piston 4 after the driver blade 4A strikes against the nail. The piston bumper 12 has a conical portion approximately the same as the inner configuration of the conical section 8*a* so as to prevent the bumper 12 from moving toward the exhaust cover 13. Compressed air is introduced into an upper space of the cylinder 8 to move a piston 4 toward a nail.

At an upper outer peripheral surface of the cylinder 8, a plurality of ribs 226 integrally protrude radially outwardly with a space in a circumferential direction of the cylinder 8. These ribs 226 are engaged with the separator 25. Thus, the cylinder 8 is fixedly supported to the main housing 2 through the separator 25 and the exhaust cover 13 so as to prevent the cylinder 8 from accidentally moving toward the exhaust cover 13.

In case of a nail driving operation, the piston bumper 12 is subjected to a small amount of force, because the nail driving power is almost consumed as a result of actual nail driving into a workpiece. On the other hand, if nail driving operation is performed without feeding a nail in the tail cover 18, all force necessary for nail driving is applied to the piston bumper 12. Thus, the piston bumper 12 is greatly deformed.

As a result of deformation, a force F exerted on the conical section 8*a* becomes large, so that a component of force F1 exerted on the cylinder 8 and directing toward the exhaust cover 13 is also becomes large. Thus, this component of force F1 urges the cylinder 8 upwardly. In order to resist the component of force F1, high mechanical strength or rigidity of the separator 25, the exhaust cover 13, and the main housing 2 must be required, which in turn increases in production cost and a total weight of the nail gun, and decreases in internal volume of the compressed air chamber 3.

SUMMARY OF THE INVENTION

It is an object of the present invention to overcome the above-described problems and to provide an improved nail gun capable of reducing production cost and a total weight, and ensuring an internal volume of a compressed air chamber without any increase in rigidity of the separator, the exhaust cover and the main housing.

This and other objects of the present invention will be attained by a pneumatically operated nail gun including a main housing, a cylinder, a piston, a driver blade, a plurality of ribs, a force receiving section, and a damper member. The main housing defines therein a compressed air chamber, and the cylinder is disposed in the main housing. The piston is slidably movable in the cylinder between its upper dead center and a lower dead center and divides the cylinder space into an upper cylinder space and a lower cylinder space. The driver blade extends from the piston in the lower cylinder space and is protrudable from a lower end of the main housing for striking against a head of the nail in accordance with the movement of the piston toward its lower dead center by compressed air fed from the compressed air chamber to the upper cylinder space. The plurality of ribs protrude from the cylinder radially outwardly and are spaced away from each other in a circumferential direction of the cylinder. Each rib has a seat portion. The force receiving section is positioned in confrontation with and downstream of the seat portion in a moving stroke of the piston toward its upper dead center. The damper member is interposed between the seat portion and the force receiving section.

DETAILED DESCRIPTION OF THE PREFERRED EMBODIMENTS

Figure 1:
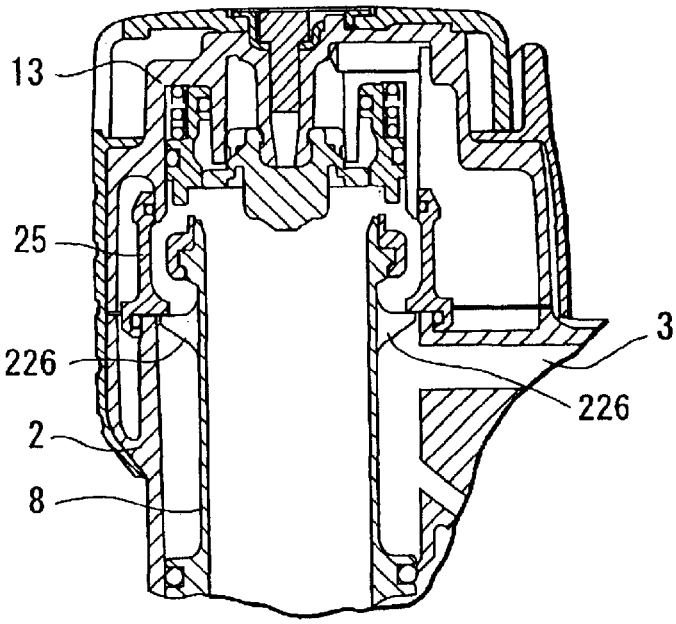
FIG. 1 PRIOR ART
FIG. 1 is a partial cross-sectional view showing an upper part of a conventional nail gun.

A nail gun according to a first embodiment of the present invention will be described with reference to FIGS. 3 through 6. The nail gun 1 includes a main housing 2, a handle 2A integrally therewith, and an exhaust cover 13 fixed to an upper end of the main housing 2 by bolts (not shown). A combination of the main housing 2, the handle 2A and the exhaust cover 13 serves as a main body and defines therein a compressed air chamber 3. An air hose (not shown) is connectable to the handle 2A. The air hose is fluidly connected to a compressor (not shown) so as to supply compressed air into a compressed air chamber 3.

A cylinder 8 is disposed in and fixed to the main housing 2. The cylinder 8 is formed with intermediate vent holes 9 at an axially intermediate position thereof and with lower vent holes 10 at a lower end portion thereof. An inner diameter of the lower portion of the cylinder 8 is gradually increased toward the lower end of the main housing 2 to provide a conical section 8*a*.

A return air chamber 7 is defined by an inner peripheral surface of the main housing 2 and an outer peripheral surface of the cylinder 8 for accumulating therein compressed air supplied through the intermediate vent holes 9 and the lower vent holes 10 during downward movement of a piston 4. The return air chamber 7 is adapted for returning the piston 4 from its lower dead center to its upper dead center.

An O-ring 11 having a check valve function is assembled to outlet ends of the intermediate vent holes 9 for allowing compressed air to pass from the cylinder 8 to the return air chamber 7 but preventing the compressed air from passing through the intermediate vent holes 9 from the return air chamber 7 into the cylinder 8.

The piston 4 is slidably and reciprocally movably disposed in the cylinder 8, and a driver blade 4A extends from a lower end surface of the piston 4. The piston 4 divides an internal space of the cylinder 8 into upper cylinder space and a lower cylinder space. A tip end 4*b* of the driver blade 4A can protrude out of the main housing 2 for striking against a head of a nail 19 in accordance with a downward movement of the piston 4.

An inner diameter of the cylinder 8 is slightly greater than an outer diameter of the piston 4. An annular ring groove 4*a* is formed in an outer peripheral surface of the piston 4, and an O-ring 5 is assembled in the ring groove 4*a*. The O-ring 5 is made from a resilient or elastic material such as rubber to provide sealing contact between the cylinder 8 and the piston 4.

A piston bumper 12 is fixedly positioned within and at the lower end portion of the cylinder 8 for absorbing or dumping surplus energy of the piston 4 after driving the nail. The piston bumper 12 has a tapered outer surface in such a manner that the outer diameter is gradually increased toward the lower end of the main housing 2 and in a shape in conformance with the conical section 8*a* of the lower portion of the cylinder 8. With this arrangement, upward displacement of the piston bumper 12 relative to the cylinder 8 can be prevented.

A nail injecting section 15 is provided at a lower side of the main housing 2. The nail injecting section 15 includes a magazine 16, a nail feed mechanism 17 and a tail cover 18. The magazine 16 is adapted for accommodating nails 19. The nail feed mechanism 17 is adapted for feeing nails 19 from the magazine 16 to the tail cover 18. The tail cover 18 is formed with a guide hole 18*a* for guiding movement of the driver blade 4A. The guide hole 18*a* also serves as a nail injection passage. The guide hole 18*a* has an inner diameter slightly greater than an outer diameter of the driver blade 4A for facilitating axial movement of the driver blade 4A relative to the guide hole 18*a*.

In the exhaust cover 13, an exhaust passage 13*a* is formed for discharging compressed air to an atmosphere. Further, a main valve 20 is positioned above the cylinder 8 and is movable toward and away from an upper end of the cylinder 8. The main valve 20 is a three-way valve. A compressed air in the compressed air chamber 3 can be introduced into the cylinder 8 and applied to an upper surface of the piston 4 when the main valve 20 is moved upward, and fluid communication between the compressed air chamber 3 and the upper space of the cylinder 8 is shut off when the main valve 20 is seated on the upper end of the cylinder 8. A valve chamber 20*a* is defined by the main valve 20 and the exhaust cover 13. When compressed air in the valve chamber 20*a* is discharged therefrom, the main valve 20 can be moved upwardly to provide the fluid communication between the compressed air chamber 3 and the upper space of the cylinder 8.

The upper space of the cylinder 8 can be communicated with the atmosphere through the exhaust passage 13*a* when the main valve 20 is moved downwardly so as to discharge compressed air in the upper space of the cylinder 8 to the atmosphere. That is, an exhaust valve rubber 21 is disposed in a center portion of the exhaust cover 13. When the main valve 20 is moved downward, an annular space is provided between the inner surface of the main valve 20 and the lower end of the exhaust valve rubber 21 so that the compressed air in the upper space of the cylinder 8 can be flowed through the annular space and is discharged into the exhaust passage 13*a*. On the other hand, when the main valve 20 is moved upwardly, the annular space disappears to block fluid communication between the upper space of the cylinder and the atmosphere.

A trigger lever 22 is provided near the handle 2A and a control valve 23 is disposed to be operated by the manipulation of the trigger lever 22. The control valve 23 provides a first valve position by the manipulation to the trigger lever 22 to fluidly communicate the valve chamber 20*a* with the atmosphere, and provides a second valve position by non-manipulation to the trigger lever 22 to shut off the fluid communication between the valve chamber 20*a* and the atmosphere and to fluidly communicates the valve chamber 20 with the compressed air chamber 3.

A sleeve like separator 25 is provided to interconnect the main housing 2 with the exhaust cover 13. A plurality of ribs 26 protrude from an upper outer peripheral surface of the cylinder 8 radially outwardly, and are positioned at equal space in the circumferential direction thereof, so that compressed air passages 27(FIG. 5) are provided between the neighboring ribs 26 and 26. Each ribs 26 has a stepped portion abuttable on a lower end face of the separator 25 so as to prevent the cylinder 8 from accidental movement toward the exhaust cover 13 due to the application of excessive force to the lower conical section 8*a* of the cylinder 8 caused by excessive deformation of the piston bumper 12. The engagement of the ribs 26 with the separator 25 also prevents the unwanted movement of the cylinder 8 toward an upper dead center of the piston 4 when the inner pressure in the return air chamber 7 is greater than the inner pressure of the compressed air chamber 3.

Figure 4:
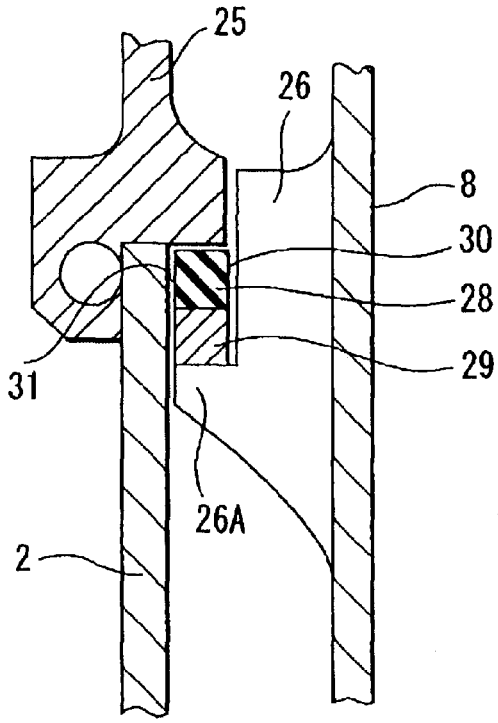
FIG. 4 is an enlarged cross-sectional view showing an essential portion of the first embodiment.
Figure 5:
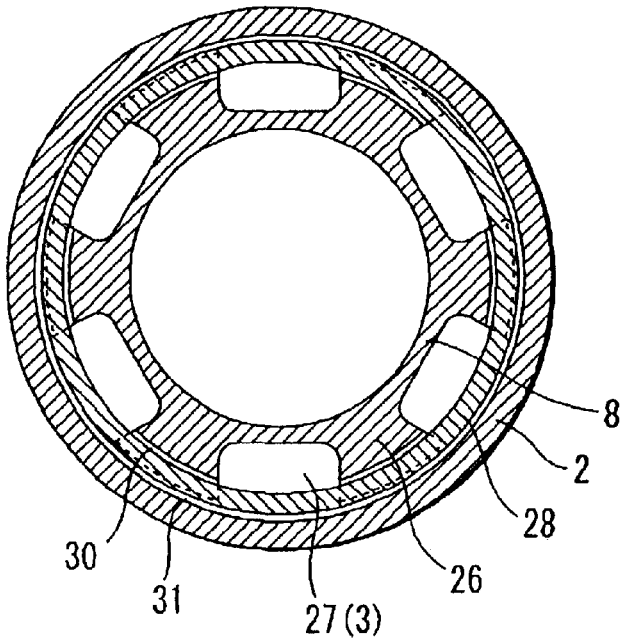
FIG. 5 is a cross-sectional view taken along the line X—X of FIG. 6.

In order to moderate a force applied to the lower end face of the separator 25, as shown in FIGS. 4 and 5, a damper ring 28 and a metal washer 29 are interposed in a space defined by the stepped portion 26A, the outer edges of the rib 26, an inner peripheral surface of the main housing 2, and the lower end face of the separator 25. To be more specific, the metal washer 29 has an endless ring shape and is mounted on the stepped portion 26A, and the damper ring 28 is seated on the metal washer and is made from a flexible material such as a rubber to moderate force directed toward the exhaust cover 13. By way of the metal washer 29, the damper ring 28 can receive uniform force along its circumferential direction in spite of the intermittent arrangement of the ribs 26. In other words, a deformation of the damper ring 28 in a corrugated fashion can be avoided by the metal washer 29.

As shown in FIGS. 4 and 5, an inner intermittent space 30 is provided between the inner peripheral surface of the damper ring 28 and the outer peripheral surface of the ribs 26. Further, an outer annular space 31 is provided between the outer peripheral surface of the damper ring 28 and the inner peripheral surface of the main housing 2. These inner intermittent space 30 and the outer annular space 31 permit the damper ring 28 to be deformed but regulate excessive deformation of the damper ring 28 and protect the damper ring 28 from damage.

Figure 3:
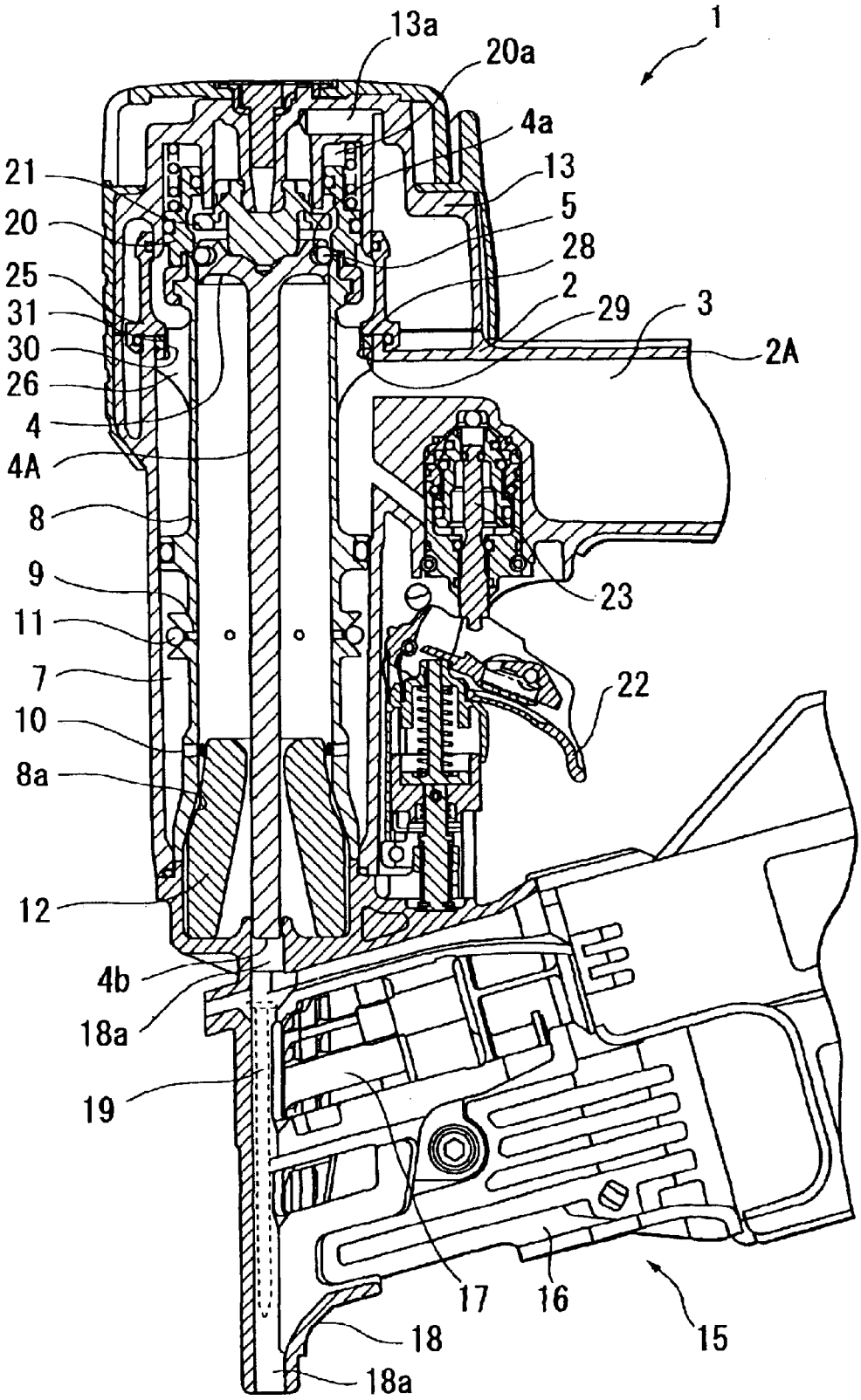
FIG. 3 is a cross-sectional view showing a pneumatically operated nail gun according to a first embodiment of the present invention and showing a state prior to nail driving.

In operation, before the trigger lever 22 is manipulated, compressed air in the compressed air chamber 3 is applied to the valve chamber 20*a* through the control valve 23, so that the main valve 20 is urged to be seated on the upper end of the cylinder 8. Therefore, compressed air in the compressed air chamber 3 cannot be applied to the upper space of the cylinder 8, thereby maintaining the piston 4 at its upper dead center position as shown in FIG. 3.

Figure 6:
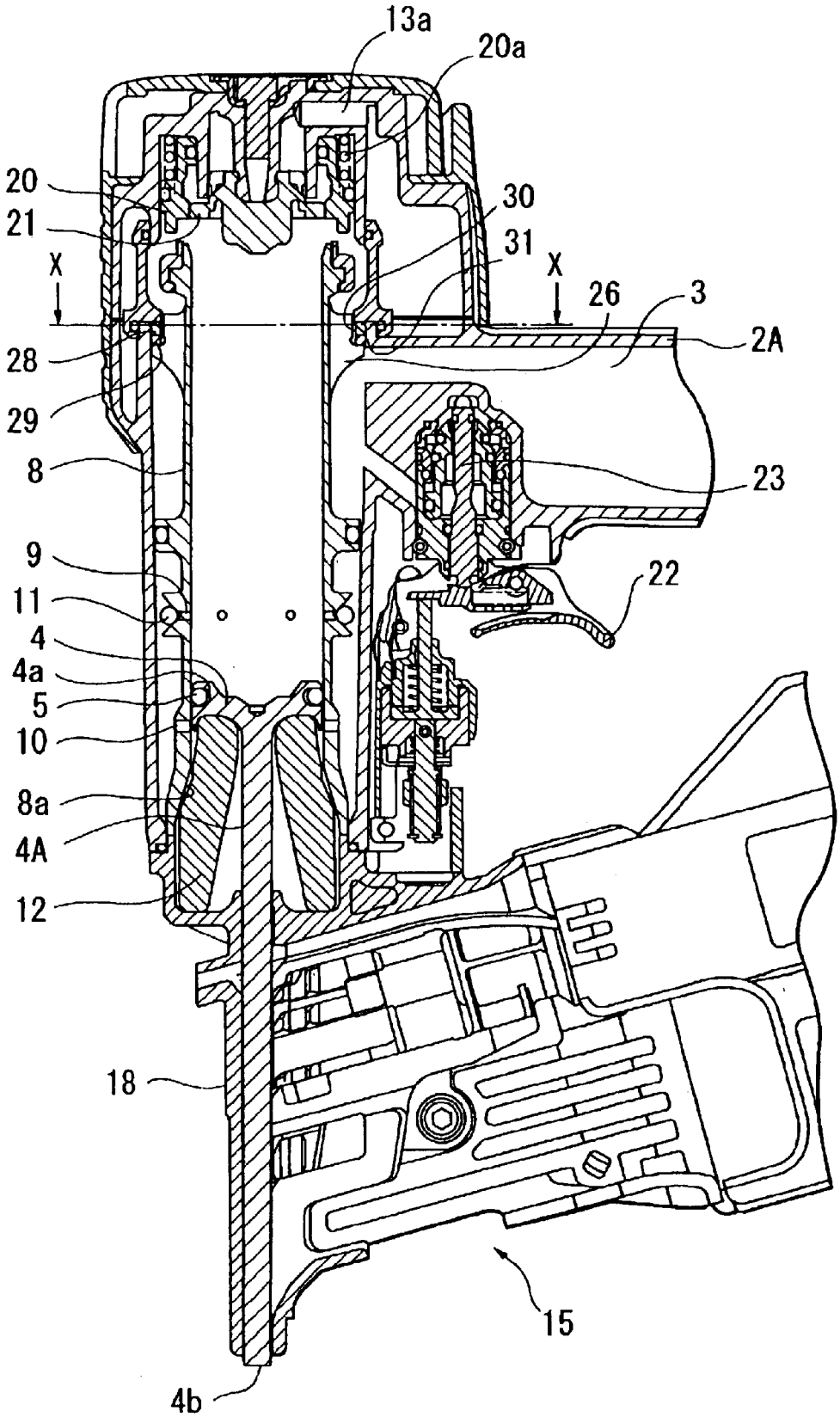
FIG. 6 is a cross-sectional view showing the nail gun according to the first embodiment and showing a state after nail driving.

When the trigger lever 22 is pulled as shown in FIG. 6, compressed air in the valve chamber 20*a* is discharged to the atmosphere, so that the main valve 20 is moved away from the upper end of the cylinder 8. Accordingly, compressed air in the compressed air chamber 3 is introduced into the upper space of the cylinder 8 and is applied to the piston 4. Thus, the piston 4 and the driver blade 4A are rapidly moved toward the nail 21 fed in the guide hole 18*a*. Nail driving power is provisionally set greater than an estimated resistive force from a workpiece so as to ensure nail driving irrespective of variation in hardness of the workpiece. Thus, after the nail driving operation, the piston 4 strikes against the piston bumper 12, whereupon the piston bumper 12 is deformed to absorb surplus energy of the piston 4.

During movement of the piston 4 toward its lower dead center, the air in the lower space of the cylinder 8 is discharged into the return air chamber 7 through the vent holes 9 and 10. When the piston 4 is moved past the intermediate vent holes 9, the compressed air in the upper space of the cylinder 8 can also be discharged into the return air chamber 7 through the intermediate vent holes 9.

Figure 2:
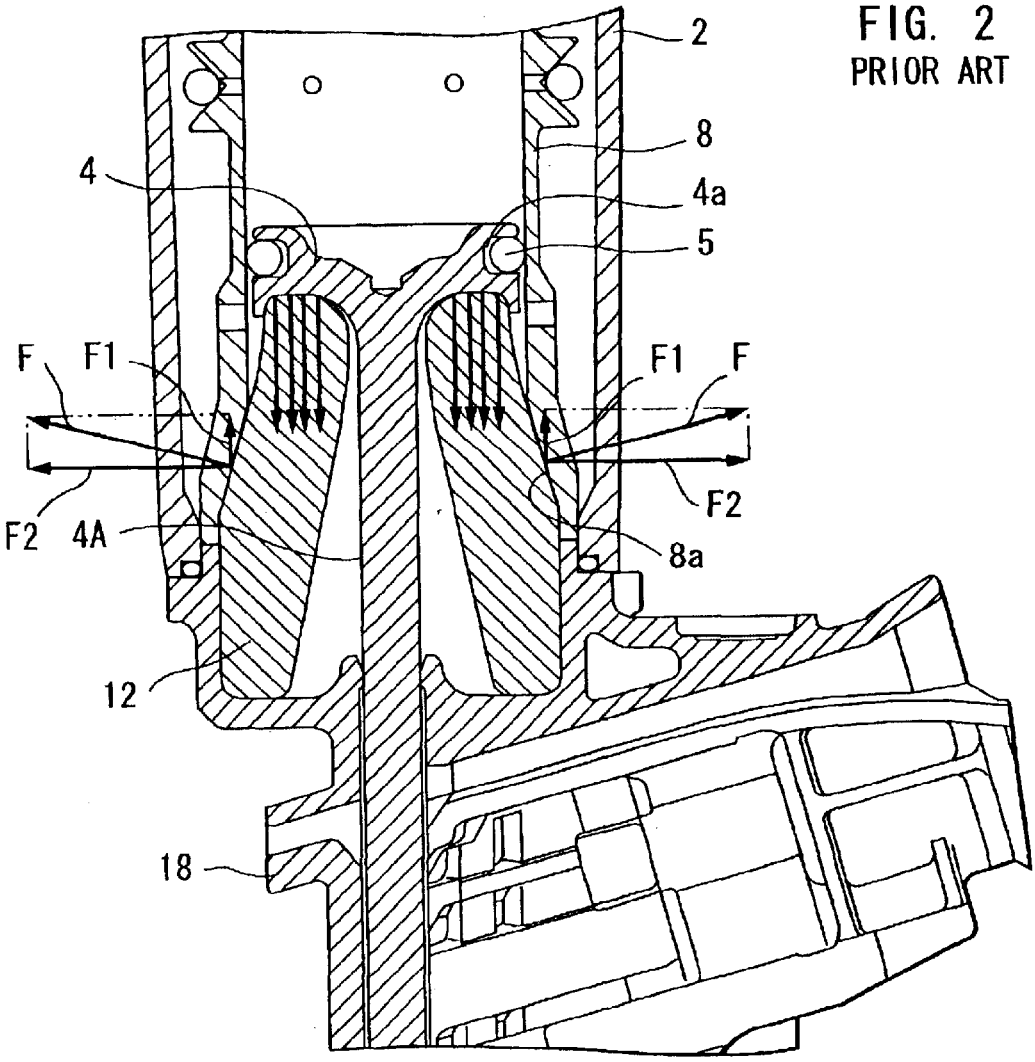
FIG. 2 PRIOR ART
FIG. 2 is a partial cross-sectional view showing a lower part of the conventional nail gun for description of force F generated at a lower part of a cylinder.

The piston bumper 12 is urged radially outwardly upon striking the piston 4. By this urging force, the conical section 8*a* of the cylinder 8 is subjected to force F directing perpendicular to the conical surface as shown in FIG. 2. Accordingly, a component of force F1 directing vertically upwardly and another component of force F2 directing horizontally are provided. This component of force F1 is urged to move the cylinder 8 upwardly. However, in the illustrated embodiment, the upward displacement of the cylinder 8 can be avoided because of the engagement of the ribs 26 with the separator 25. Moreover, because the damper ring 28 is interposed between the cylinder 8 and the separator 25, the component of force F1 is absorbed by the damper ring 28 upon deformation and dampening thereof. Furthermore, because the endless washer 29 made from metal is seated on the ribs 26 and the damper ring 28 is mounted on the endless washer 29, the damper ring 28 can receive the component of force F1 uniformly in its circumferential direction. Furthermore, because spaces 30 and 31 are provided, excessive deformation of the damper ring 28 can be avoided, and destruction of the damper ring can be prevented.

Because of the provision of the damper ring 28, and formation of the spaces 30 and 31, impact force to be applied to the separator 25, the exhaust cover 13 and the main housing 2 can be moderated or dampened even in a case of nail driving operation without setting a nail 19 at the guide hole 18*a* of the tail cover 18. Therefore, excessively high rigidity is not required in the separator 25, the exhaust cover 13 and the main housing 2, thereby reducing production cost and total weight of the nail gun, and increasing an internal volume of the compressed air chamber 3.

When the trigger lever 22 is released, the compressed air in the compressed air chamber 3 is introduced into the valve chamber 20*a* to close the main valve 20, i.e., the main valve 20 is seated on the upper end of the cylinder 8. By this movement of the main valve 20, the upper space of the cylinder 8 is communicated with the atmosphere through the discharge passage 13*a*, and therefore, compressed air which has been applied to the upper space of the cylinder 8 is discharged to the atmosphere. Simultaneously, compressed air accumulated in the return air chamber 7 is applied to the lower surface of the piston 4, so that the piston 4 can return to its upper dead center. Thus, a single shot cycle is terminated.

Figure 7:
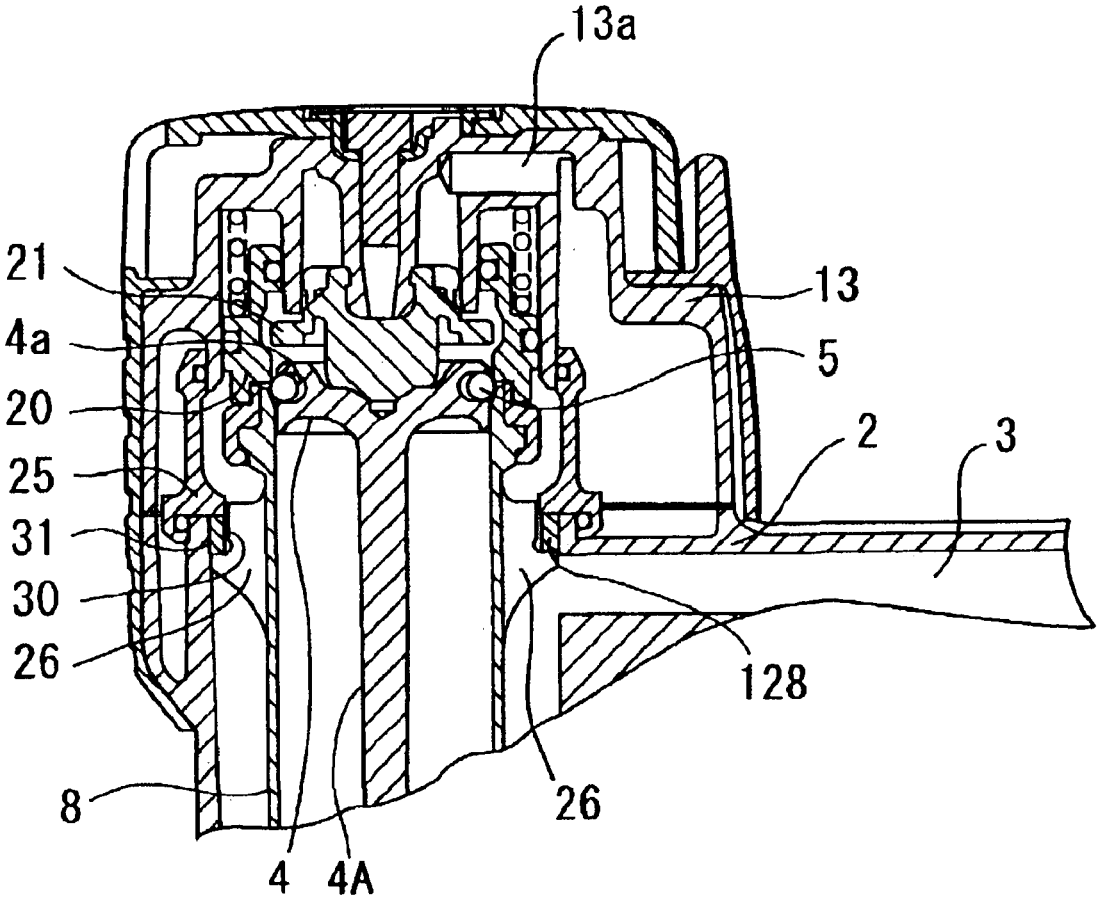
FIG. 7 is a partial cross-sectional view showing a pneumatically operated nail gun according to a second embodiment of the present invention.

FIG. 7 shows a nail gun according to the second embodiment of the present invention. In this embodiment, only a damper ring 128 is installed in the space defined by the ribs 26, the inner peripheral surface of the cylinder 8, and the lower end face of the separator 25. An axial length of the damper ring 128 is greater than that of the ring 28 of the first embodiment so as to provide a sufficient strength for sustaining against the upward force F1 and avoiding corrugated deformation of the ring 128 yet providing a sufficient resiliency for absorbing the component of force F1.

While the invention has been described in detail with reference to specific embodiments thereof, it would be apparent to those skilled in the art that various changes and modifications may be made therein without departing from the spirit and scope of the invention. For example, in the depicted embodiments, spaces 30 and 31 are formed at radially inner and outer sides of the damper ring 28, 128. However, at least one of the inner space 30 and the outer space 31 is sufficient as long as the space can allow the damper ring to be deformed but regulates excessive deformation thereof.

What is claimed is:

1. A pneumatically operated nail gun comprising:

a main housing defining therein a compressed air chamber and having a lower end;

a cylinder disposed in the main housing;

a piston slidably movable in the cylinder between its upper dead center and a lower dead center and dividing the cylinder space into an upper cylinder space and a lower cylinder space;

a driver blade extending from the piston in the lower cylinder space and protrudable from the lower end of the main housing for striking against a head of the nail in accordance with the movement of the piston toward its lower dead center by compressed air fed from the compressed air chamber to the upper cylinder space;

a plurality of ribs protruding from the cylinder radially outwardly and spaced away from each other in a circumferential direction of the cylinder, each rib having a seat portion;

a force receiving section positioned in confrontation with and downstream of the seat portion in a moving stroke of the piston toward its upper dead center; and a damper member interposed between the seat portion and the force receiving section.

2. The pneumatically operated nail gun as claimed in claim 1, wherein the cylinder has a lower portion provided with a conical section whose inner and outer diameters are gradually increased toward the lower dead center of the piston; and the nail gun further comprising:

a piston bumper disposed at the lower portion and having a configuration in conformance with the conical section.

3. The nail gun as claimed in claim 2, further comprising an endless metal washer member seated on each seat portion of each rib, the damper member being mounted on the endless metal washer.

4. The nail gun as claimed in claim 1, further comprising an exhaust cover fixed to a top end of the main housing, and a separator mechanically interconnecting the exhaust cover to the main housing; a combination of a part of the main housing and a part of the separator defining the force receiving section.

5. The nail gun as claimed in claim 4, wherein at least one of an inner space and an outer space is provided, the inner space being defined by an inner peripheral surface of the damper ring and each rib, and the outer space being defined by an outer peripheral surface of the damper ring and the part of the main housing.

6. The nail gun as claimed in claim 1, wherein the damper ring is made from a rubber.

* * * * *